US005833394A

United States Patent [19]

McCavour

[11] Patent Number: 5,833,394

[45] Date of Patent: Nov. 10, 1998

[54] COMPOSITE CONCRETE METAL ENCASED STIFFENERS FOR METAL PLATE ARCH-TYPE STRUCTURES

[75] Inventor: Thomas C. McCavour, Etobicoke, Canada

[73] Assignee: Michael W. Wilson, New Brunswick, Canada

[21] Appl. No.: 662,070

[22] Filed: Jun. 12, 1996

[51] Int. Cl.[6] ..... E01F 5/00

[52] U.S. Cl. ..... 405/126; 405/288

[58] Field of Search ..... 405/124, 125, 405/126, 151, 288; 52/86, 87, 783.14, 796.1

[56] References Cited

U.S. PATENT DOCUMENTS

| | | | |
|---|---|---|---|
| 2,067,493 | 1/1937 | Kinzie | 61/45 |
| 3,508,406 | 4/1970 | Fisher | 61/16 |
| 3,509,725 | 5/1970 | Schnabel | 61/45 |
| 3,673,806 | 7/1972 | Hanig | 61/45 R |
| 3,855,801 | 12/1974 | Bernold | 61/45 R |
| 4,099,359 | 7/1978 | Sivachenko | 52/630 |
| 4,099,386 | 7/1978 | Sagasta | 61/45 R |
| 4,141,666 | 2/1979 | DeGraff | 405/126 |
| 4,186,541 | 2/1980 | Sivachenko | 52/630 |
| 4,318,635 | 3/1982 | Gurter | 405/126 |
| 4,390,306 | 6/1983 | Fisher | 405/124 |
| 5,326,191 | 7/1994 | Wilson | 405/124 |
| 5,375,943 | 12/1994 | McCavour et al. | 405/126 |

FOREIGN PATENT DOCUMENTS

| | | |
|---|---|---|
| 862402 | 2/1971 | Canada . |
| 2 508 072 | 12/1982 | France . |
| 26 57 229 | 7/1977 | Germany . |
| 2 140 848 | 12/1984 | United Kingdom . |

*Primary Examiner*—Tamara L. Graysay
*Assistant Examiner*—Gary S. Hartmann
*Attorney, Agent, or Firm*—Lee, Mann, Smith, McWilliams, Sweeney & Ohlson

[57] ABSTRACT

A composite concrete reinforced corrugated metal arch-type structure comprises a first set of shaped corrugated metal plates interconnected in a manner to define a base arch structure with the corrugations extending transversely of the longitudinal length of the arch and a second series of shaped corrugated metal plates interconnected in a manner to overlay the first set of interconnected plates of the base arch, the second series of plates having at least one corrugation extending transversely of the longitudinal length of the arch with the troughs of the corrugations of the second series of plates secured to the crests of the first set of plates. The interconnected series of second plates and the first set of plates define individual, transversely extending, enclosed continuous cavities filled with concrete to define an interface of the concrete enclosed by the metal interior surfaces of the second series of crests and first set of troughs. The interior surfaces of the cavities for each of the first and second plates have means for providing a shear bond at the concrete-metal interface to provide individual curved beams transversing the arch whereby the structure provides positive and negative bending resistance and combined bending and axial load resistance to superimposed loads.

19 Claims, 7 Drawing Sheets

COMPOSITE CONCRETE METAL ENCASED STIFFENERS FOR METAL PLATE ARCH-TYPE STRUCTURES

FIELD OF THE INVENTION

This invention relates to concrete reinforced corrugated metal plate arch-type structures, such as used in overpass bridges, water conduits, or underpasses, capable of supporting large superimposed loads under shallow covers such as heavy vehicular traffic and more particularly a structure which may be substituted for standard concrete or steel beam structures.

BACKGROUND OF THE INVENTION

Over the years, corrugated metal sheets or plates have proved themselves to be a durable, economical and versatile engineering material. Flexible arch-type structures made from corrugated metal plates have played an important part in the construction of culverts, storm sewers, subdrains, spillways, underpasses, conveyor conduits and service tunnels; for highways, railways, airports, municipalities, recreation areas, industrial parks, flood and conservation projects, water pollution abatement and many other programmes.

One of the main design challenges in respect of buried corrugated metal arch-type structure is that a relatively thin metal shell is required to resist relatively large loading around its perimeter such as lateral earth pressures, groundwater pressure, overburden pressure as well as other live and/or dead load over the structure. The capacity of such a structure in resisting perimeter loading is, apart from being a function of the strength of the surrounding soil, directly related to the corrugation profile and the thickness of the shell. While evenly distributed perimeter loads, such as earth and water pressures, generally would not create instability in an installed structure, the structure is more susceptible to uneven or localized loading conditions such as uneven earth pressure distribution during backfilling or live loads on the installed structure due to vehicular traffic. Uneven earth pressure distribution during the backfilling of the arch structure causes the structure to distort or peak, rendering the shape of the finished structure different from its intended most structurally sound shape. Live loads over the top of the structure, on the other hand, creates a localized loading condition which could cause failure in the roof portion of the structure.

A localized vertical load such as a live vehicular load imposed over an arch-type structure will create both bending stresses and axial stresses in the structure. Bending stresses are caused by the downward deformation of the roof thereby generating positive bending moments in the crown portion of the structure and negative bending moments near the hip portions of the structure. Axial stresses are compressive stresses caused by a component of the live load acting along the transverse cross-sectional fibre of the arch structure. In a buried metal arch structure design, the ratio of the bending stress to the axial stress experienced under a specific vertical load varies according to the thickness of the overburden. The thicker the overburden, the more distributed the vertical load becomes when it reaches the arch structure and the less bending the structure will be subjected to. The stress in an arch structure under a thick overburden is therefore primarily axial stress.

Corrugated metal sheets tend to fail more easily under bending than under axial compression. Conventional corrugated metal arch-type design deals with bending stresses created by live loads by increasing the overburden thickness, thereby disbursing the localized live loads over the thickness of the overburden and over a larger surface on the arch, the bending stresses on the arch is therefore minimized and the majority of the load is converted into axial forces. However, it is obvious that, by increasing the overburden thickness, the earth pressure on the structure is increased and stronger metal plates are therefore required. The need for a thick overburden also creates severe design limitations, such as limitation on the size of the clearance envelope under the structure or the angle of approach of a roadway over the structure. In a situation where the overburden thickness is limited and is shallow, the live load problem is traditionally solved by positioning an elongated stress relieving slab, usually made of reinforced concrete, near or immediately below the roadway extending above the area of shallow backfill. The elongated slab will act as a load spreading device so that localized vehicular loads will be distributed over a larger area on the metal arch surface. The problem with a stress relieving slab is that it requires on site fabrication thus involving additional fabrication time and substantial costs in labour and material. Moreover, in areas where concrete is not available, this is not a viable option.

Attempts have been made to strengthen a corrugated metal arch structure by the use of reinforcing ribs. In U.S. Pat. No. 4,141,666, reinforcing members are used on the outside of a box culvert to increase its load carrying capacity. The problem with that invention is that sections of the structure between the reinforcing ribs are considerably weaker than at the reinforcing ribs and hence, when loaded, there is a differential deflection or undulating effect along the length of the structure. To reduce this problem, longitudinal members are secured to the inside of the culvert to reduce undulation, particularly along the crown and base portions. It is apparent, however, that when these structures are used over stream beds or the like, it is not desirable to include inside the structure any attachments because of their tendency of being destroyed by ice flows and floods.

In U.S. Pat. No. 4,318,635, multiple arch-shape reinforcing ribs are applied to the interior/exterior of culverts to provide for reinforcement in the sides, crown and intermediate haunch or hip portions. Although such spaced apart reinforcing ribs enhance the strength of the structure to resist loads, they do not overcome the undulation problem in the structure and can add unnecessary weight to the structure by way of superfluous reinforcement. In addition to the above disadvantages, reinforcing ribs in this type of structure are often time consuming and complicated to install adversely affecting the costs of construction. Moreover, where relatively widely spaced rib stiffeners are used, structural design analyses become difficult for these structures. The discontinuity of the reinforcement and hence the variation in stiffness along the longitudinal length of a structure makes it difficult to develop the full plastic moment capacity of the section, thereby giving rise to a design that is generally unnecessarily conservative and uneconomical.

U.S. Pat. No. 3,508,406 by Fisher discloses a composite arch structure having a flexible corrugated metal shell with longitudinally extending concrete buttresses on either side of the structure. It is specifically taught that in the case of a wide spanning arch structure, the concrete buttresses may be connected with additional stiffening members extending over the top portion of the structure. Similarly, in U.S. Pat. No. 4,390,306 by the same inventor, an arch structure is taught wherein a stiffening and load distributing member is structurally fixed to the crown portion of the arch extending longitudinally for the majority of the length of the structure. It is also provided that the composite arch structure should preferably include longitudinally extending, load spreading buttresses on either side of the arch structure. The top longitudinal extending stiffener and buttresses can be made of concrete or metal and may even consist of sections of corrugated plate having its ridges extending in the length direction of the culvert.

In the Fisher patents, continuous reinforcement is provided along the structure by means of the crown stiffener and the buttresses. The buttresses are designed to provide stability to the flexible structure during the installation stage, that is, before the structure is being entirely buried and supported by the backfill. They provide lengths of consolidated material at locations to resist distortion when compaction and backfilling equipment is used, enabling the backfilling procedure to continue without upsetting the structure's shape. The top stiffener with internal steel reinforcing bars acts to weigh down the top part of the structure to prevent it from peaking during the early stages of backfilling and compaction and as a load spreading device that helps distribute the vertical loads on the structure, thus reducing the minimum overburden requirement. The top stiffener in the length direction of the structure rigidifies the top portion of the arch by using shear studs to structurally connect the concrete beam to the steel arch to provide for positive bending resistance in the arch top. This multi-component stiffener moves towards a structure which permits the use of reduced overburden but cannot provide for a large reduction in overburden thickness or for very large spans in arch design. The primarily reason is that the top stiffener in Fisher is not designed to resist negative bending moments typically found in the hip portions of shallow cover arches and wide spanning arches. The purpose of the spaced apart transverse members between the top stiffener and the side buttresses is to provide some rigidity to the structure to prevent distortion during the backfilling stage. They are not members designed to resist negative moments. Further, while an installed flexible arch structure is subject to positive bending moments at the crown under live load conditions, it is subject to negative bending moments at the same location during backfilling when it is being pressured from the sides and the top will distort by way of peaking. The top stiffener in Fisher, while it is designed to take advantage of a shear-bond connection between the concrete and steel to resist positive bending moments in the top portion of the arch, negative bending moments in the same region during backfilling are resisted simply by the provision of reinforcing bars in the upper part of the concrete slab, thus requiring in-situ forming and re-bar work, adversely affecting construction costs. Also, since the top stiffener and side buttresses are of significant sizes, the weight of the completed structure is substantially increased.

In Sivachenko, U.S. Pat. No. 4,186,541, a method of forming corrugated steel plates from flat plate stock for use in constructing, inter alia, metal arch structures is disclosed. Specific reference was made to the additional strength advantage of a double corrugated plate configuration wherein plates are joined together along opposite troughs either directly or with spacers between them. It is noted that the double plate assembly may be left hollow or may be filled with concrete or a like material. The concrete between the plates may be reinforced with conventional reinforcing steel bars which may be oriented parallel or transversely to the corrugations of the plates. It is apparent that when concrete is placed between the plates without reinforcement, it will only act as a filler and will not enhance the strength characteristics of the assembly. Even when the concrete is provided with reinforcing bars, the re-bars are not designed for shear-bond connection between the concrete and the corrugate steel plates and when the assembly is subject to bending, the concrete and steel plates function independently of one another. That system moves towards a method of stiffening a corrugated metal plate structure by the use of a double plate assembly with a concrete-filled centre typical of a sandwich-type support structure. In the case of a burried arch structure with multiple curves, the installation of re-bars in accordance with Sivachenko will become an even more difficult task.

In U.S. Pat. No. 5,326,191 continuous corrugated metal sheet reinforcement is secured to at least the crown of the culvert extending continuously over the length of the culvert. This culvert design solves the problem associated with prior art spaced apart transverse reinforcement and is inherently capable of resisting both positive and negative bending moments. However, continuous reinforcement on large span structures can become cost prohibitive and difficult to install.

SUMMARY OF THE INVENTION

The concrete reinforced corrugated metal arch-type structure of this invention overcomes a number of the above problems. The composite concrete metal beams, as provided by this invention enhance the structure's resistance to both positive and negative bending moments induced in the structure by virtue of either shallow overburden supporting live heavy load vehicular traffic or during backfilling of the arch-type structure. Each continuous concrete filled cavity defined by interconnecting an upper plate and a lower corrugated plate of this invention will act as a composite metal encased concrete beam functioning as a curved beam column stiffener with, bending moment and axial load capacities to provide for greater design flexibility in providing arch structures with shallow overburden.

According to an aspect of the invention, a composite concrete reinforced corrugated metal arch structure comprises:

i) a first set of shaped corrugated metal plates interconnected in a manner to define a base arch structure of a defined span cross-section, height and longitudinal length, said base arch having a crown section and adjoining hip sections for said span cross-section and corrugated metal plates of defined thickness having corrugations extending transversely of the longitudinal length of said arch to provide a plurality of curved beam columns in said base arch;

ii) a second series of corrugated metal plates with at least one corrugation are interconnected in a manner to overlay and contact the first set of interconnected plates of said base arch with trough portions of the second corrugated plate secured to crest portions of first set of plates, said second series of interconnected plates extending continuously in the transverse direction from a base portion of one of said hip sections over said crown section to a base portion of the other of said hip sections;

iii) said interconnected series of second plates and said first set of plates defining a plurality individual, transversely extending, enclosed continuous cavities, each said cavity being defined by an interior surface of said first set of plates and an opposing interior surface of said second series of plates;

iv) concrete filling each said continuous cavity from cavity end to end as defined by the transverse extent of said second series of plates, said concrete filled cavity defining an interface of said concrete encased by said metal interior surfaces of said interconnected second series of plates and first set of plates;

v) said interior surfaces of said cavity for each of said first and second plates having a plurality of shear bond connectors at said encased concrete-metal composite interface, said composite shear bond connectors being a rigid pan of said first and second plates to ensure that the concrete and metal act in unison when a load is applied to said arch structure, said shear bond connectors providing a plurality of curved beam column stiffeners to enhance combined positive and negative bending resistance and axial load resistance of said base arch structure, there being a sufficient number of said second series of plates to provide a sufficient of said curved beam column stiffeners to support anticipated loads imposed on said structure.

BRIEF DESCRIPTION OF THE DRAWINGS

Preferred embodiments of the invention are described with respect to the drawings wherein.

DETAILED DESCRIPTION OF THE PREFERRED EMBODIMENTS

In accordance with this invention, a large span arch-type structure is provided where the structure is constructed of corrugated steel plates. Large span is intended to encompass, in accordance with the preferred embodiments, arch spans in excess of 15 m and most preferably in excess of 20 m. The structure of this invention with spans of this range are capable of supporting large loads such as heavy vehicular traffic loads with minimal overburden coverage and no requirement for a concrete relieving slab or any other type of stress relieving or distributing devices above the arch structure. It is understood of course that the arch structure of this invention may be employed for smaller spans where particular specifications dictate, or in taking advantage of the features of the structure of this invention, substantially thinner steel plate may be used. In the alternative, other lower strength metals may be substituted for the steel such as aluminum alloys by virtue of the enhanced load carrying characteristics of the preferred structure.

Figure 1:
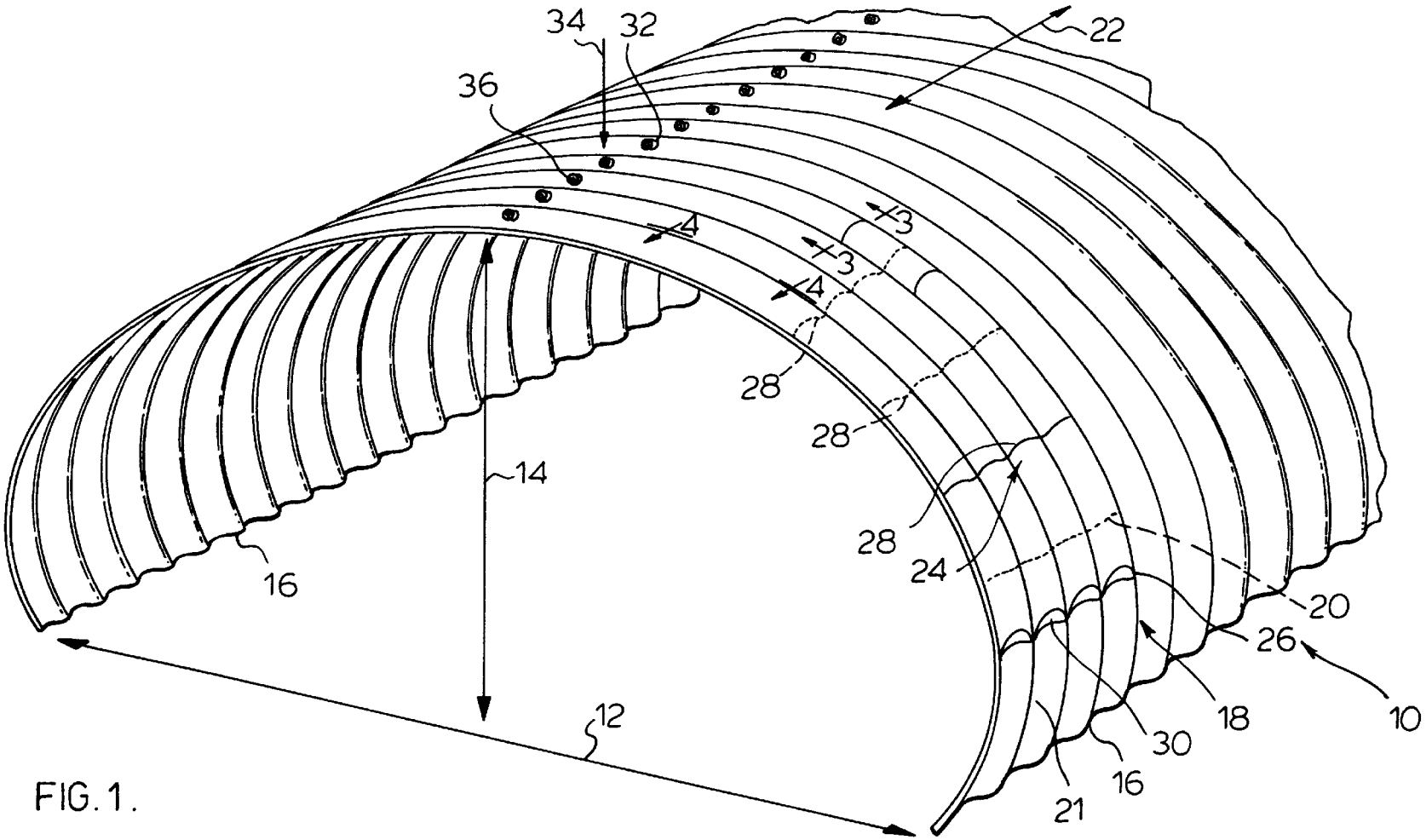
FIG. 1 is a perspective view of a re-entrant arch structure in accordance with an aspect of this invention.

With reference to FIG. 1, an aspect of the invention is described as used in an arch-type structure commonly referred to as a re-entrant arch. It is understood of course that the structure of this invention may be used with a variety of corrugated arch-type designs which include ovoids, box culvert, round culvert, elliptical culvert and the like. The structure 10 has a span, as indicated by line 12 and a height, indicated by line 14. The cross-sectional shape of the arch in combination with a height dimension and span dimension, define the clearance envelope for the arch structure which is designed to accommodate underpass traffic which may be pedestrian cars, trucks, trains and the like. Alternatively, the arch 10 may be used to bridge a river or other type of water course. The base portion 16 of the arch is set onto suitable footings in accordance with standard arch engineering techniques. The arch 10 is constructed by interconnecting a first set of shaped corrugated steel plates generally indicated at 18 where their juncture is defined by dotted line 20. The first set of interconnected plates define the base arch structure providing the desired cross-sectional span 12 and height 14. The longitudinal length direction of the arch is indicated by line 22 which determines the number of interconnected plates which are needed to provide the desired arch length. The arch length is primarily determined by the width of the overpass. The corrugated interconnected first set of plates having the individual corrugations provide a corresponding plurality of curved beam columns. Each corrugation 21 as it transverses the arch functions as a curved beam column which resists positive and negative bending moments and axial loading in the structure of the base arch.

Figure 3:
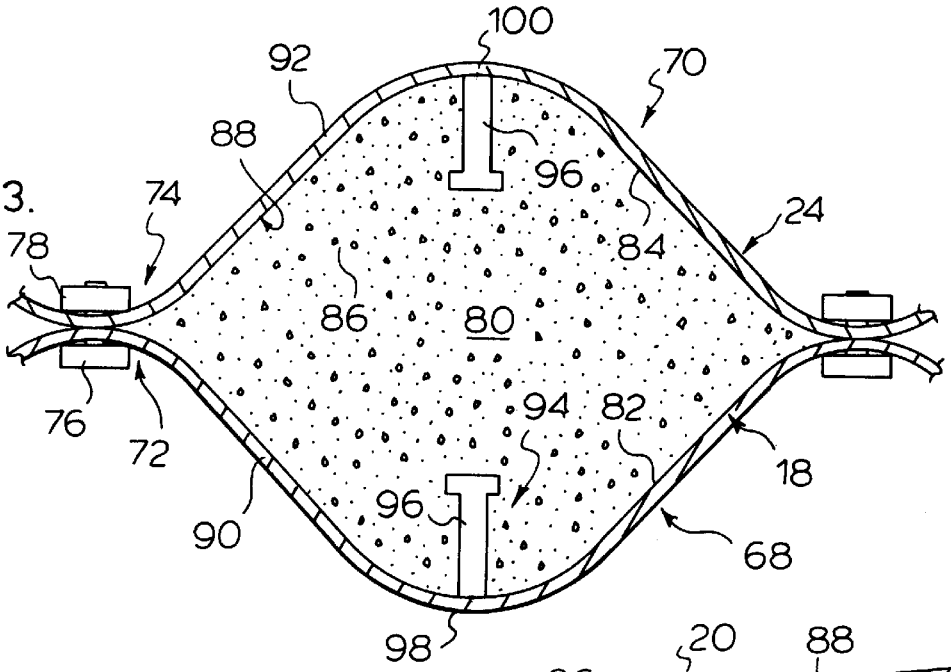
FIG. 3 is a section along the line 3—3 of FIG. 1.

As will be shown in more detail with respect to FIG. 3, the plates are of corrugated metal, preferably steel, of a defined thickness having crests and troughs extending transversely of the arch's longitudinal length 22. In accordance with various aspects of the invention, metal encased concrete stiffeners can be formed in various ways by placing a series of second plates on top of the first set of plates. In order to realize the advantages of this invention, the composite concrete/metal stiffeners must be formed by enclosing the concrete between the first and second plates. Various alternative shapes for the series of second plates are described in respect of the Figures.

In the first embodiment, the series of plates are provided as a second set of corrugated plates extending continuously in both the transverse and length directions of the arch. The second set of shaped corrugated steel plates 24 are interconnected in a manner to overlay the first set of plates 18. The second set of plates each have a defined thickness with crests and troughs extending transversely of the arch's longitudinal length 22. The troughs of the second set of plates are secured to the crests of the first set of plates. In accordance with this particular embodiment, the second set of plates terminate at 26 where lines 28 indicate the juncture of the interconnected second set of plates. As will be described with respect to FIG. 2, the second set of plates may extend the entire transverse section of the arch or a major portion thereof depending upon the arch design requirements in providing suitable stiffeners for the curved beam columns of the base structure. The second set of plates extend over the effective arch length for supporting load. It is understood that in providing the overburden, depending upon the angle of repose or shape of the sides of the overburden, a portion of the base arch may extend beyond the overburden and since it is not supporting any load, does not require a second set of plates in that region of the crown and/or hip sections of the base arch.

As will be described in more detail with respect to the following Figures, the cavities defined between the crests in this embodiment of the second plates and the troughs of the first plates, which extend from the termination section 26 for each hip region of the arch are filled by plugging the open end of each cavity with a suitable plug 30. Holes 32 are then formed in the crests of the top plates to allow injection of concrete into the enclosed cavity, as indicated by arrow 34. It is understood that several holes 32 may be provided along the cavity to facilitate injection of the concrete to fill the cavity and avoid formation of any voids in the cavities so that a proper composite, concrete steel interface is provided, as will be described in FIGS. 3 and 4. Once the cavities are filled with concrete, the openings 32 are optionally plugged with suitable plugs 36.

Figure 2:
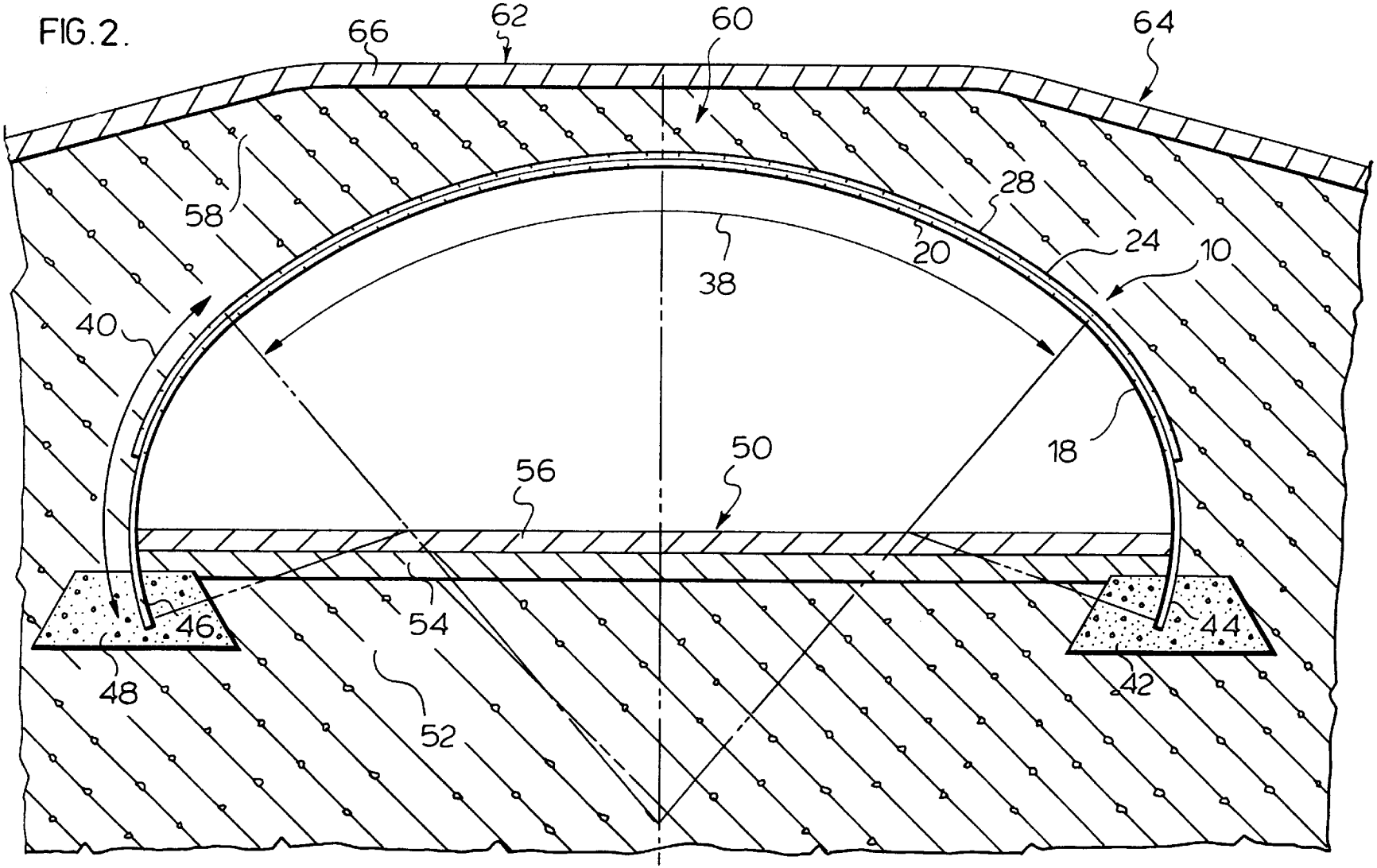
FIG. 2 is an end view of the bridge structure of FIG. 1.

The arch 10, as shown in FIG. 2, is of the re-entrant arch design having a crown section, as defined by arc 38 and opposite hip sections, as defined by respective arcs 40. The first set of plates 18 define the base arch which extends from suitable footing 42 at a first end 44 to the second end 46 provided in footing 48. The second set of plates 24 extend continuously over the crown section 38 and over portions of the hip sections. The extent of extension of the second set of plates over portions of the hip section 40 depends upon the design requirements. In accordance with this embodiment, the second set of plates 24 extend over a majority of the hip section above the underpass surface 50. It is understood however that the second set of plates may extend to the base portions 44 and 46 of the arch or may extend just to within the hip sections depending upon the design requirements for resisting positive and negative bending moments and axial loads. As shown in FIG. 2, the lines 20 indicate the connection region of the first set of plates and the lines 28 indicate the interconnection of the second set of plates.

When a roadway is to be provided through the arch structure, the roadway 50 is constructed in accordance with standard roadway specifications. The footings 42 and 48 are placed on compacted fill 52. Above the compacted fill is a layer of compacted granular 54. The roadway 50 may be a layer of reinforced concrete and/or compacted asphalt 56. The span 12 and height 14 is of course selected to define a clearance envelope sufficient to allow the designated vehicular traffic, water course or the like to pass under the arch 10.

Figure 17:
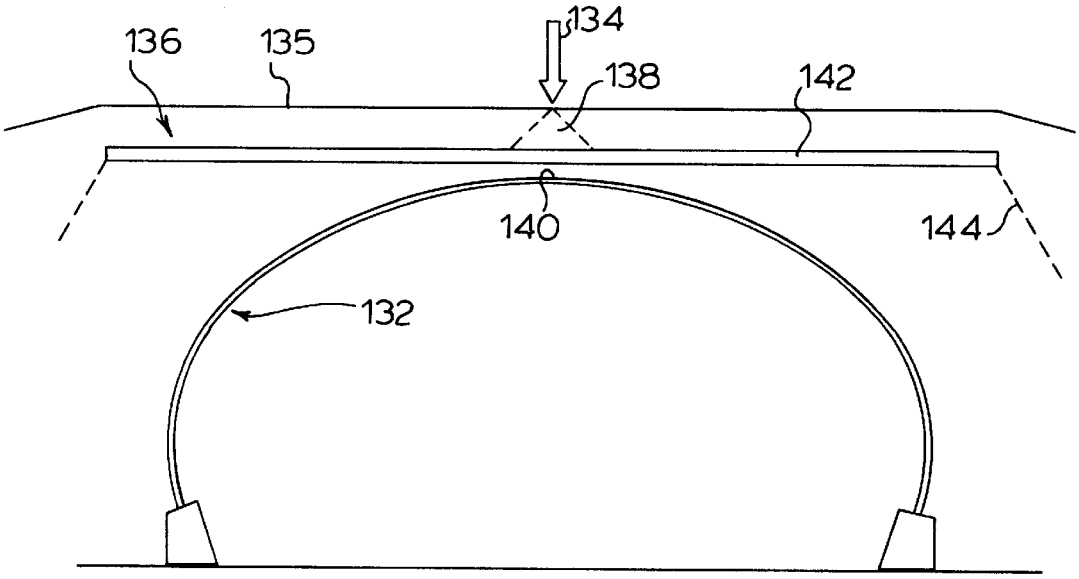
FIG. 17. (PRIOR ART)
FIG. 17 is a section through a prior art structure having a relieving slab.
Figure 18:
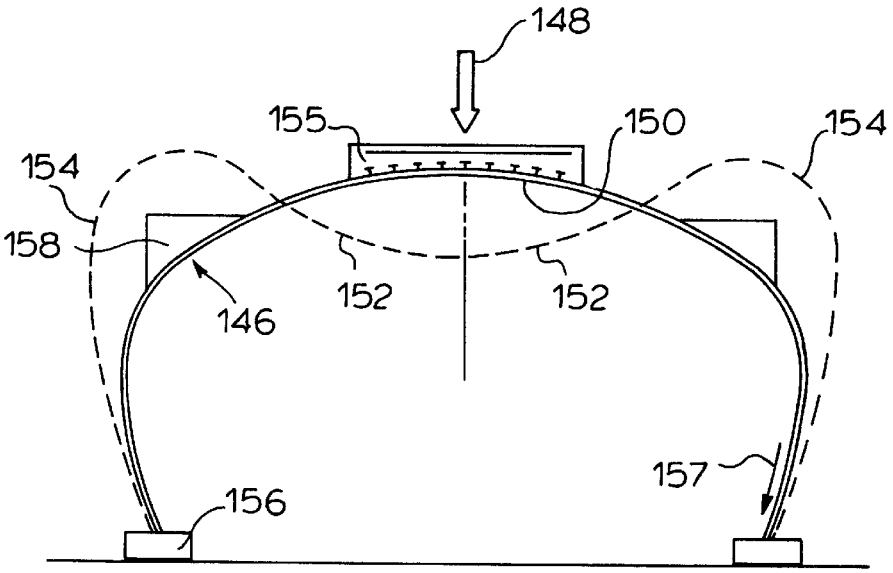
FIG. 18 (PRIOR ART)
FIG. 18 is a section through the prior art structure having top reinforcement and buttress reinforcements.

Above the arch 10, the area is backfilled with compacted fill 58 having a relatively minimal overburden in region 60. Normally with large span steel structures, concrete relieving slabs or the like, as will be described with respect to FIG. 17, are positioned to support in conjunction with the steel arch 10 the heavy live loads such as vehicular traffic on the overpass surface 62. With the structure of this invention, such relieving slabs or other forms of concrete reinforcement on top of the crown section 38, as shown in FIG. 18, are not needed where a minimum amount of overburden 60 is required. This is significantly beneficial in designing the overpass surface 62 because the slope of the approach 64 is considerably reduced. The overpass surface 62 is constructed in the normal manner where section 66 has the usual compacted layer of granular material and an upper layer of concrete and/or asphalt. In accordance with this invention, by providing circumferentially transversely extending continuous curved stiffeners, defined by discrete contained cavities, such structure provides a reinforced arch which readily supports heavy live vehicular traffic load on the overpass 62. The metal encased concrete in the discrete cavities defined between the first and second plates provide a composite arch structure of unified design to resist bending and axial loads superimposed on the arch structure.

The composite reinforcing stiffener of this invention is provided in the contained cavity defined by the overlapping first and second set of plates 18 and 24. As shown in section 3—3 of FIG. 3, the corrugated steel plate of the first set defines a trough 68 in opposition to a crest 70 of the second plate. In accordance with this particular embodiment, the first and second corrugated plates have a sinusoidal corrugation which is identical for the first and second plates 18 and 24. The first and second plates are interconnected where the apex of the crest 72 of the first plate contacts the apex of the trough 74 of the second plate. The plates may be secured in this region by various types of fasteners. Preferably the use of bolts 76 extending through aligned apertures in the first and second plates are secured by suitable nuts 78. The cavity 80, as defined by the interior surfaces 82 of the first plate and 84 of the second plate extends from the termination ends 26 of the second plates in a continuous manner transversely of the arch. Concrete 86 fills the cavity 80 to define a composite interface 88 at the juncture of the concrete 86 with the interior surfaces 82 and 84 of the respective plate walls 90 and 92. When the arch structure is loaded, the metal/concrete interface acts in a composite reinforcing manner by virtue of devices 94 provided on the interior surfaces 82 and 84 of the first and second plates which provide a shear bond at the interface 88, between the metal plates 90 and 92 and the concrete 86. The shear resistance of the devices 94 is selected depending upon the design requirements of the arch bridge 10. It is understood that the shear connector devices 94 may either be integral with the plates 90 and 92 or secured thereto in resisting shear at the interface 88. In accordance with the particular embodiment of FIG. 3, the shear connector devices 94 are individual studs 96 secured to the interior surfaces 82 and 84. In this particular embodiment, the studs 96 are secured at the apex 98 of the troughs 68 and the apex 100 of the crest 70 of the second set of plates. Such location of the shear bond connectors enhances the strength of the curved beam by providing shear bond at the outermost and innermost fibre of the stiffener where shear stress is at a maximum during bending.

Figure 4:
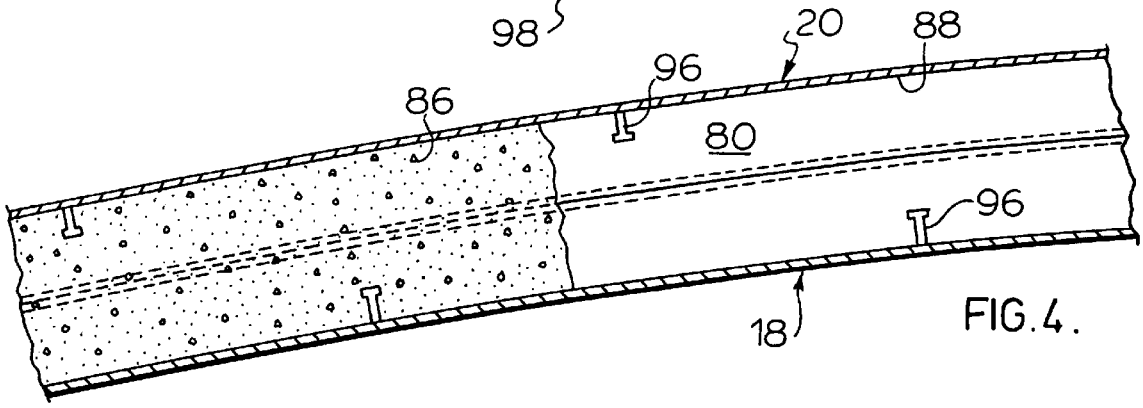
FIG. 4 is a section along the line 4—4 of FIG. 1.

The strengthening characteristics of the individual adjacent curved stiffeners is shown in more detail in FIG. 4. The first and second plates 18 and 20 define the continuous enclosed form of concrete 86 to provide a composite concrete/steel member by virtue of the shear connectors 96. The shear connectors 96 ensure at the composite interface 88 that the concrete and steel act in unison when a load is applied to the arch structure. With this design, in accordance with the invention, the enhanced stiffeners in the arch are capable of resisting both positive and negative bending moments in the arch caused by moving overhead loads such as heavy vehicular traffic load. Other designs are not capable of inherently providing in the structure significant positive and negative bending resistances. Other designs require the use of relieving slabs or steel reinforcing bars above the structure to either reduce or to provide positive and negative bending resistance. Other benefits which flow from the composite in accordance with this invention is that there can be a reduction in the thickness or weight of the metal used in constructing the first and second plates. Metals other than steel, such as aluminum alloys, may be used in the plates. The contained adjacent composite steel concrete stiffeners also can accommodate considerably greater spans and have reduced deflection, most importantly, they permit the use of less overburden in the arch design, hence requiring less skill in the backfilling operation of the arch structure or alternatively being able to accommodate a relatively lower grade backfill material. The provision of the first and second plates connected together in a manner to define the contained cavities for the concrete greatly facilitate erection of the structure while providing greatly increased spans for the structure, as will become apparent from the following examples in analyzing the comparative strengths of construction. To ensure that the concrete in the cavity 80 functions as a composite supporting structure, as shown in FIG. 4, the shear connector studs 96 are spaced apart from one another as they are attached to the respective troughs 68 of the first plate and crests 70 of the second plate. In addition, the opposing sets of studs are staggered relative to one another to optimize shear bond at the concrete steel interface 88.

Figure 5:
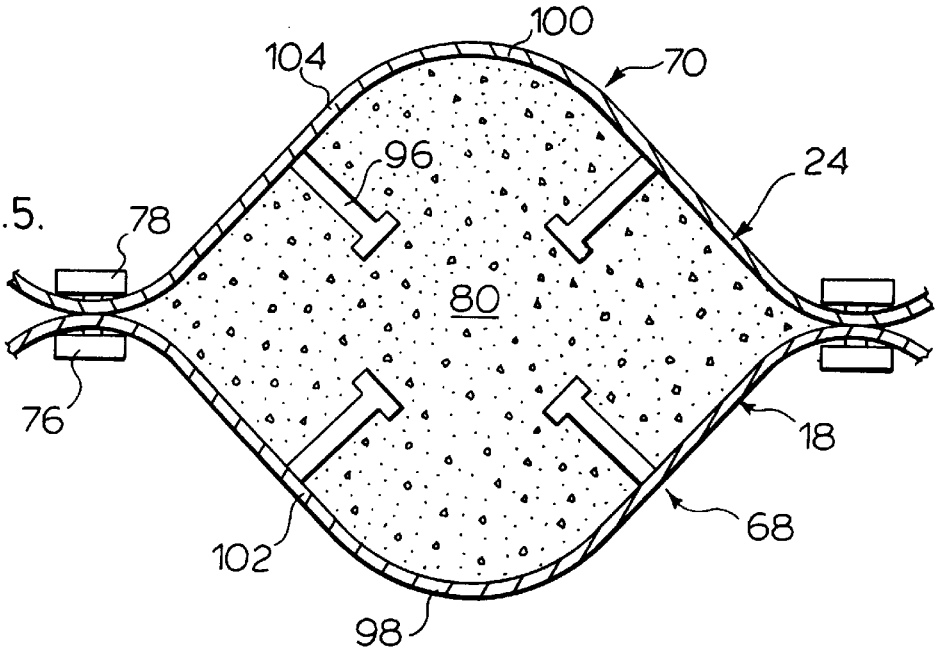
FIG. 5 shows an alternative embodiment for the shear connectors of FIG. 3.

As shown in FIG. 5, an alternative arrangement for the connector studs 96 is provided. The trough 68 has downwardly sloping sides 102 and the crest 70 has upwardly sloping sides 104. The shear connector studs 96 are then positioned on these downwardly sloping sides of the trough and the upwardly sloping sides of the crest to thereby increase the number of connector studs within the cavity 80 while at the same time providing a desired spacing in the cavity transverse extending direction.

Figure 6:
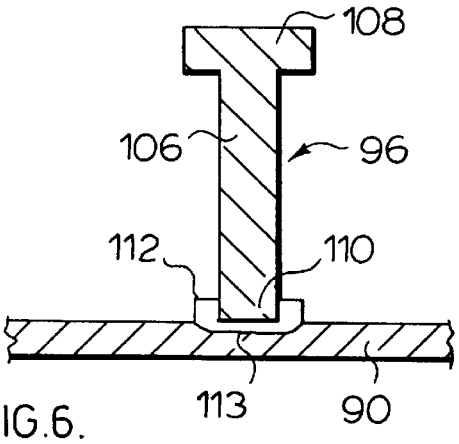
FIG. 6 is an enlarged view of a shear connector secured to the interior of one of the corrugated plates.

With reference to FIG. 6, the preferred studs 96 with a post portion 106 and a circular enlarged head portion 108, have their base portion 110 thereof resistance welded to the first plate steel wall 90. In accordance with this embodiment, the resistance welds 112 consume some of the base metal 113 in connecting the shear studs 96 in place.

Figure 7:
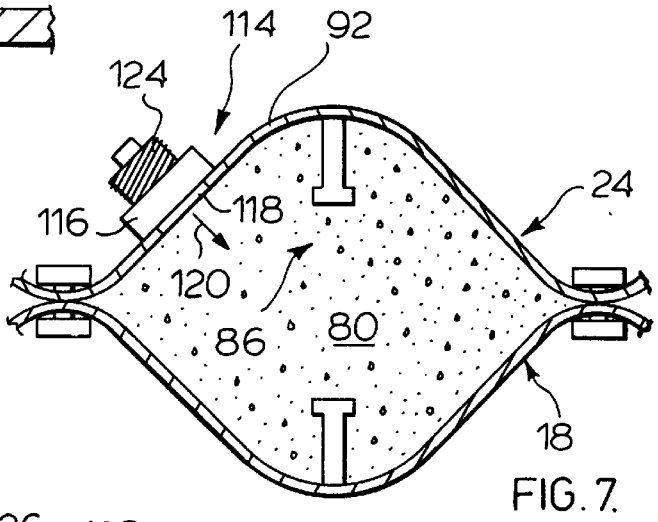
FIG. 7 is a section similar to FIG. 3 showing a grout plug for introducing concrete to the cavity.

The section of FIG. 7 shows the cavity 80 being filled with concrete 86 through a grout nozzle 114. The grout nozzle has a coupling 116 which is secured to the wall 92 of the plate 24. The coupling has an aperture 118 where concrete is injected into the cavity 80 in the direction of arrow 120 by connecting the concrete pump line to the coupling 116. Once filling of the cavity with the concrete 86 is completed, a suitable plug 124 may be threaded into the coupling to close off the aperture 118 to complete the installation of the concrete. It is of course appreciated that other techniques may be employed for filling the cavities with concrete such as adapting the end of the concrete pump line with a releasable coupling which momentarily connects to an aperture in the plate wall 92 for purposes of filling and is then removed and a bung or the like secured in the opening of the plate 92.

Figure 8:
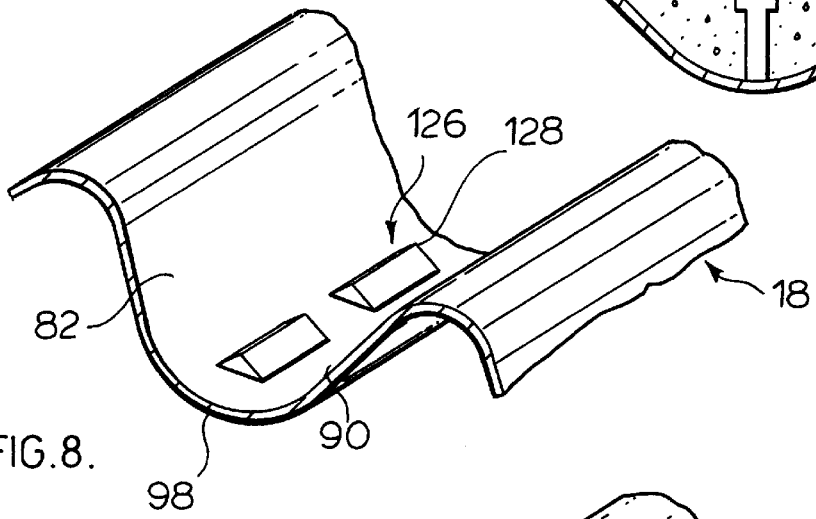
FIG. 8 is a section of the corrugated plate having an alternative embodiment for shear bond devices.
Figure 9:
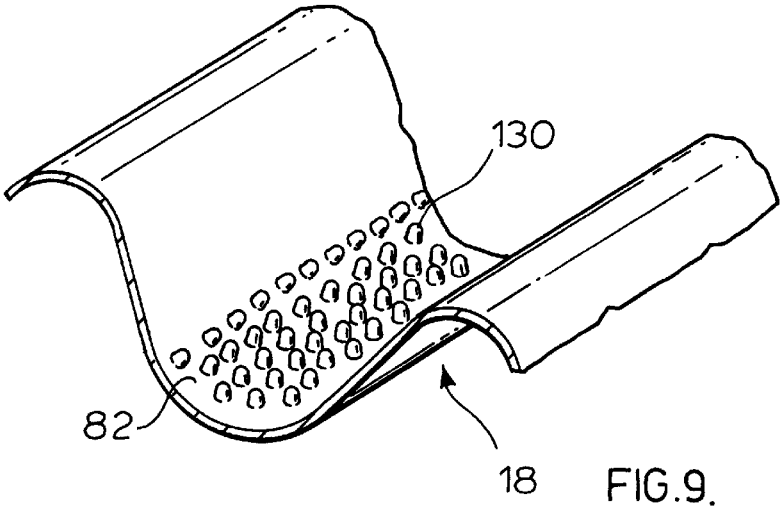
FIG. 9 is a section of the corrugated plate showing yet another alternative embodiment for the shear bond devices.

As previously described, various types of shear bonding devices may be formed on the interior surfaces of the first and second plates. FIG. 8 shows spaced apart shear bond connectors 126 formed in the plate wall 90 of the first plate 18. The integral shear bond connectors are preferably formed along the apex of the trough 98. The connectors 126 may be stamped in the plate wall 90 and project inwardly with defined peaks 128. As the concrete sets in the cavity the inwardly projecting integrally formed peaks 128 provide the necessary shear bond with the interior surface 82 of the plate. Similarly, with the alternative embodiment of FIG. 9, the first plate 18 has formed on its interior surface 82 a plurality of embossments 130. The embossments 130 are integrally formed in the interior surface and are of a depth sufficient to provide a shear bond with the concrete when pumped and set within the cavity of the assembled structure.

Figure 10:
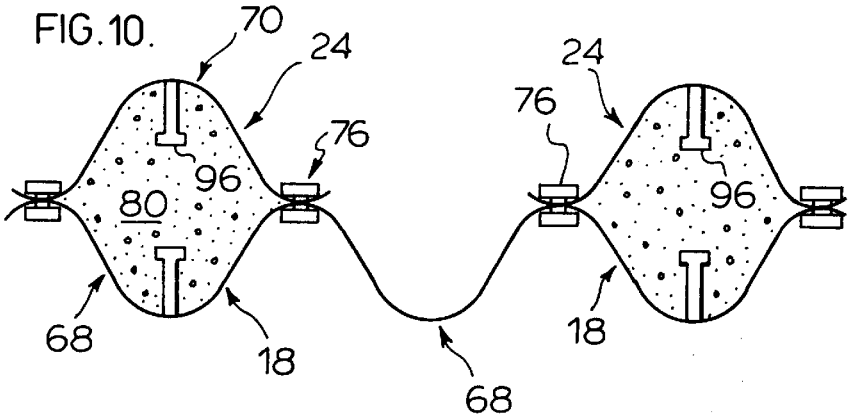
FIGS. 10, 11, 12, 13, 14, 15 and 16 are sections through the first and second corrugated plates showing alternative embodiments for the second series of plates relative to the first set.
Figure 11:
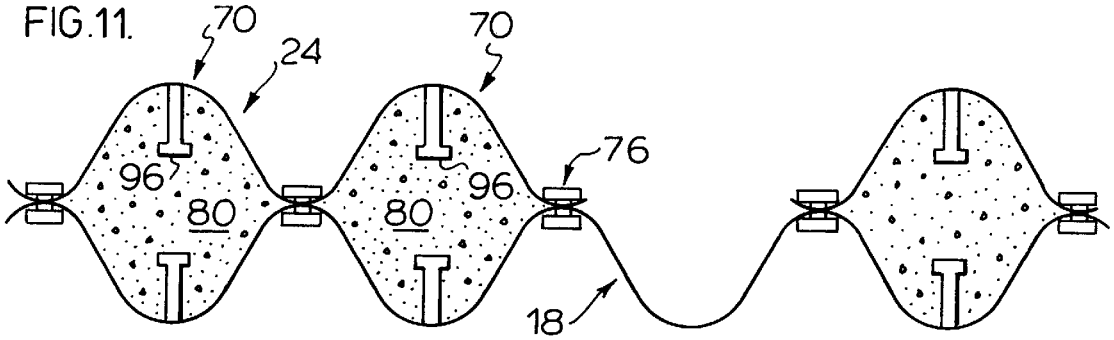
Figure 12:
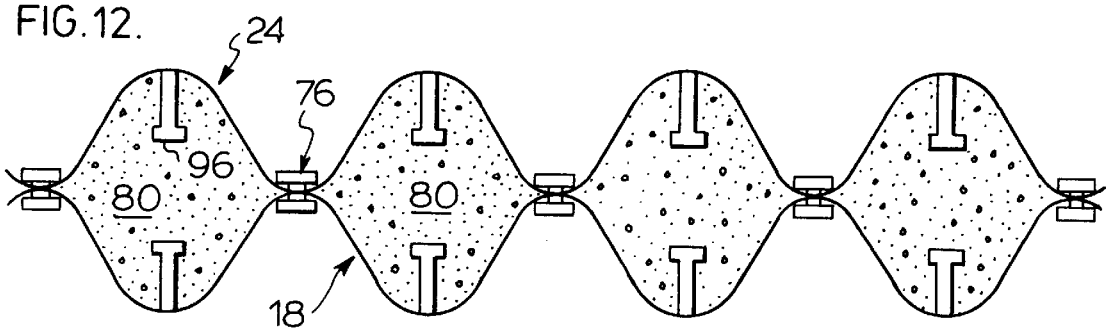

FIGS. 10, 11 and 12 show alternative arrangements for the first and second plates to provide various spacings for the curved beams in the length direction of the arch. In FIG. 10 the base of the arch is provided by a plurality of interconnected plates 18. At selected positions along the base of the arch a series of second plates 24 are connected to position the trough 68 opposite the crest 70 of the second plate in defining the cavity 80. One or more of the troughs 68 may be skipped with the second series of plates 24 to thereby provide spaced apart arch stiffeners interconnected by the corrugations of the base plates 18. Alternatively, as shown in FIG. 11, the second series of plates 24 may include multiple corrugations providing multiple crests 70 and hence multiple cavities 80. One or both of the multiple cavities in each series of second plates 24 is filled with concrete as indicated by the shear bond connectors 96. With the structures of FIGS. 10 and 11, the curved stiffeners carry the load where the corrugations of the base plates 18 interconnect these beams to provide a unitary structure. It is appreciated that depending upon the anticipated or designed-for loads the spacing of the beams can thus be determined to provide the necessary positive and negative bending resistance and axial load resistance in the complete structure. It is also appreciated that the second plate 24 may have 3 or more corrugations. However, for a 75 cm width steel plate, of a thickness of about 3 to 7 mm it is difficult to form more than 2 corrugations of sufficient depth and pitch. Alternatively, if a aluminum plate is used of 120 cm width, it is possible to provide at least three and up to four corrugations because aluminum is easier to form.

With the embodiment of FIG. 12, the series of second plates 24 are provided continuously across the base plates 18. The sets of plates are interconnected by bolts 76 where at some locations up to 4 thicknesses of plates would be interconnected. Although this complicates assembly, the resultant structure in having every adjacent cavity of the opposing corrugated first and second plates filled with concrete provides a very sturdy structure to optimize resistance to positive and negative bending and axial loads in the arch when supporting superimposed loads or supporting the structure during backfilling. One of the advantages in the structures described with respect to FIGS. 10 and 11, is that the series of interconnected second plates do not overlap thereby avoiding situations where up to 4 thicknesses of plates have to be interconnected, as with the embodiment of FIG. 12.

Figure 13:
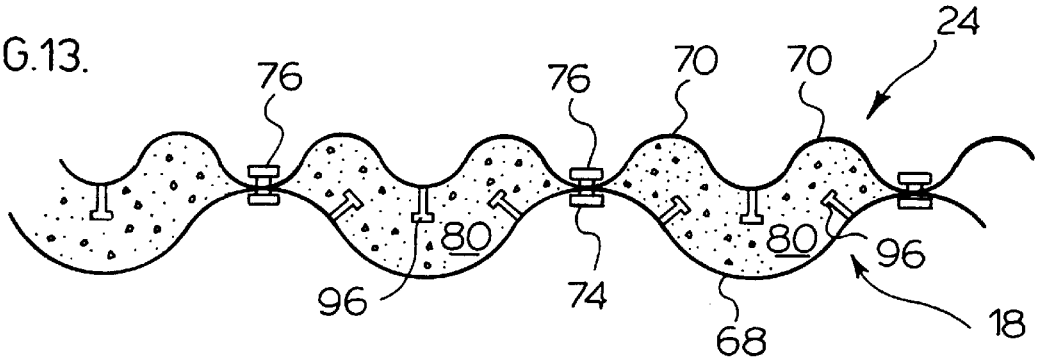
Figure 14:
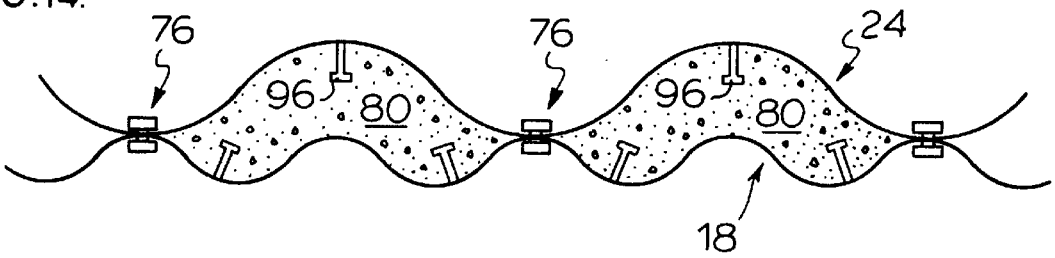

FIGS. 13 and 14 show alternative embodiments in respect of varying the pitch of the corrugation in the first and second plates relative to one another. In FIG. 13, the second plate 24 has a pitch to the sinusoidal corrugations where the crests 70 are spaced apart ½ the distance of the trough 68 of the first plate 18. This arrangement provides for less corrugations in the first plate which may be of a thicker material than the second plate which has a greater number of corrugations per unit width of the second plate. Shear bond connectors 96 are provided in the cavities 80 in the manner shown to form the curved beam stiffener for reinforcing the base arch structure.

Alternatively, as shown in FIG. 14, the second plate 24 may have less corrugations that the first plate 18. In essence, it is the inverse of the cross-section of FIG. 13 only the pitch for both the first and second plates is increased, as indicated by the distance between the bolts 76. As with the embodiment of FIG. 13, the shear bond connectors in the form of studs 96 are provided in the cavities 80 to provide the composite concrete metal stiffeners.

Figure 15:
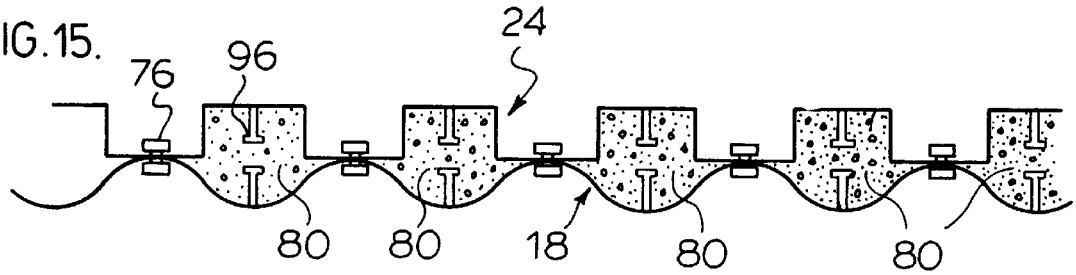

It is apparent from FIGS. 13 and 14 that the cavity 80 may take on a variety of cross-sectional shapes in forming the composite metal-encased concrete stiffener. A further alternative is shown in FIG. 15, where the second plate 24 has a polygonal shaped corrugation, which in accordance with this embodiment, is square shaped, although it is understood that the second plate 24 may have other shapes of polygonals such as a trapezoidal, triangular and the like. As with the other embodiments, shear stud connectors 96 are provided in the cavities 80 to form the desired composite concrete metal stiffeners in reinforcing the base arch structure. With the arrangement of FIG. 15, the second plate 24 with the polygonal shaped corrugations allows for a greater amount of concrete to be above the plane of the crests of the first plate 18.

Figure 16:
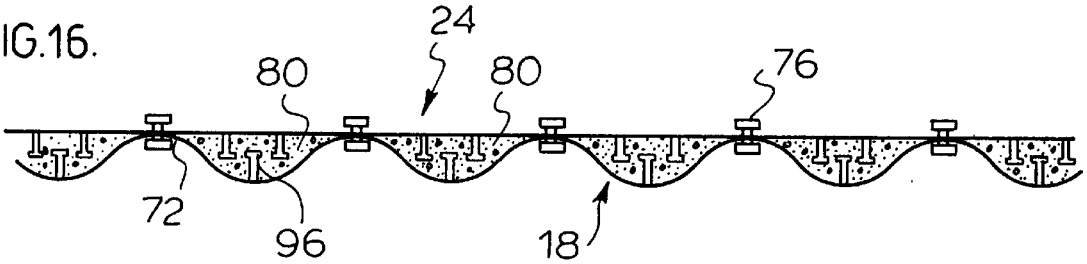

The arrangement of FIG. 16 provides a flat second plate 24 connected to the first plate 18. Here the flat. plate 24 lies in the plane defined by the apexes of the crests 72 of the first plate. The shear stud connectors 96 may be provided in the cavity 80 in the manner shown where each of the cavities 80 may be filled. The use of a flat second plate in the series of second plates facilitates special shapes that may be necessary in traversing the arch, for example, in regions of the arch where the radius of curvature is relatively small, the flat second plate 24 may be more readily curved to match the curvature of the first plate 18.

With the various embodiments of FIGS. 10 through 16, it is apparent that the cavity design in cross-sectional shape, may vary greatly. It is understood that in providing the most efficient form of composite concrete metal stiffener for bending moment resistance that the cavity should extend above and below the plane of the crests of the first plate to thereby define the greatest possible distance between the outer and inner fibres of the stiffener, that is, the greatest section modulus for the stiffener. Hence, the preferred shape for the first and second plates is that described with respect to FIGS. 10 through 12 where the opposing crests of the second plate are spaced the furthest from the opposing troughs of the first plate to thereby maximize section modulus of the individual composite concrete metal encased stiffeners.

A surprising benefit which flows from the various embodiments of this invention in providing stiffeners is that the spans of the structure may be greatly increased over traditional types of steel arch structures which had other types of stiffeners. By providing a unique curved stiffener of composite concrete and metal material having a shear bond at the interface, very significant modifications may be made to the arch design to provide novel clearance envelopes. None of the prior art structures allow modification of the standard arch design because those standard arch designs had restricted shapes which were thought to be the only shapes for resisting bending moments in the structure. When the second series of plates extend from the base of one side of the arch to the base of the other side of the arch, the increase in combined axial and bending capacity will be extended throughout the entire arch structure. Such unique composite curved beam columns where the concrete is encased in metal allows the design engineer to provide unique shapes to the curved structure to provide different types of clearance envelopes, minimum overburden and gentler approach slopes. Normally, such alternative designs could only be accomplished with heavily reinforced poured concrete bridge structures. The structural features of this invention therefore takes the standard type of arch design for corrugated metal components into a completely new area in providing alternatives to the expensive heavily reinforced standard concrete bridge designs.

A further benefit which flows from the ability to now design novel clearance envelopes for the arch structure is to provide regions under the arch but outside of the underpass area of the clearance envelope, which regions function as water courses, walkways, drainage, ancillary access for pedestrians, animals and small vehicular traffic such as bicycles. Although room for these additional features can be provided in more expensive formed concrete bridges, the metal arch-type structure of this invention, accomplishes these features at a considerably lower cost.

The following discussion of the prior art standard structures of FIGS. 17 and 18 in combination with the following structural analysis of these standard structures versus that of the new arch structures reveals many significant benefits of the new design.

A localized superimposed load such as a live vehicular load will generally create two kinds of stresses in a flexible arch structure. FIG. 18 shows the typical deformation 154 suffered by an arch structure 146 of U.S. Pat. No. 4,390,306 under a localized load. Due to the downward load 148 on the crown 150 of the structure, positive bending moments 152 are created in the crown portion of the structure and negative bending moments 154 are induced in the hip portions. This particular design attempts to deal with positive bending moments by providing a slab 155. However, the buttresses 158 do nothing to resist the negative bending stresses in the hip portions because the structure can flex in that direction. The vertical live load will also find its way into the transverse cross-sectional fibre of the structure transmitting the vertical axial load 157 to the foundation 156 of the structure. The ratio of the bending stresses to the vertical stresses in such a structure for a defined vertical load varies according to thickness of the overburden. Generally speaking, the thinner the overburden, the more localized the live load will become when it reaches the surface of the arch structure, the more deformation will occur in the roof and the higher bending stresses will be in the structure.

Standard flexible corrugated metal arches 132 of FIG. 17 are particularly weak in resisting bending stresses. Traditional design tends to limit the amount of bending in the structure by trying to disperse as much as possible the localized live load 134 over the structure. The most obvious way is by increasing the thickness of the overburden soil 136. A point load acting on the overburden soil will distribute itself over the thickness of the soil in accordance with a stress distribution envelope 138 as shown in dot in FIG. 13. When the load reaches the crown surface 140 of the metal arch shell, it will be a load that is acting over a large area of the shell surface. The main stress in the structure therefore becomes axial stress rather than bending stress. In traditional buried flexible arch design, a standard minimum overburden cover must be provided. In a situation where the thickness of the overburden is limited and is less than the minimum requirement, a stress relieving slab 142 must be provided to further expand the stress distribution envelope 144 over and outside the structure. The stress relieving slab 142 may be positioned on top of the arch 132, at the surface 135 or at any position in between. As the slab 142 is positioned close to the top of the arch, the stress distribution envelop shape would of course change. In any event, the amount of concrete used in the stiffener design of this invention is considerably less than what has to be used in a relieving slab.

The following engineering analysis demonstrates the surprising benefits derived from the design of this invention. A composite concrete reinforced corrugated metal arch-type structure of the type shown in FIGS. 1 and 4 was designed. The first set of shaped corrugated metal plates was made of 3 ga thick steel in a re-entrant base arch profile with a span of 19.185 m and a height above the footings of 8.708 m. A second series of shaped corrugated metal plates made of 3 ga thick steel was interconnected in a manner to overlay the first set of interconnected plates of the base arch. The second series of plates were installed in segments with two corrugations extending transversely of the longitudinal length of the arch with the troughs of the corrugation of the second series of plates secured to the crests of the first set of plates as shown in FIG. 11.

Prior to zinc coating, shear studs as shown in FIG. 6 were attached with resistance welds to the first and second set of corrugated metal plates. The shear studs were 12 mm diameter by 40 mm long spaced 800 mm on centre. The shear studs were staggered between the first and second plates, as shown in FIG. 4. A grout nozzle was provided at the crown of the second set of plates, as shown in FIG. 7. Concrete fill with a compressive strength of 25 MPa was introduced into the cavity through the grout nozzle after the ends of the cavity had been plugged.

Site conditions required a height of cover for this structure of 1.13 m whereas contemporary bridge design standards required a minimum height of cover of 3.82 m with a non-composite metal arch structure. In order to achieve the 1.13 m height of cover a non-composite metal arch structure would require the use of 1 ga thick steel for the first set of shaped plates and 1 ga thick steel for the second set of reinforcing plates. The non-composite metal arch did not have a concrete filled void and did not have shear studs. It did however require a 300 mm thick by 20 m wide concrete relieving slab extending the full length of the structure installed at the road surface. The composite concrete reinforced structure of this invention was able to meet the design requirements for relatively low minimal value of overburden without the above problems of the above prior art structures.

The composite concrete reinforced corrugated metal arch structure provided a considerable saving in both material and fabrication costs. The cost of 3 ga thick steel with a stud was considerably less than the cost of 1 ga thick steel without shear studs. In addition the quantity of concrete for filling the voids was considerably less than the quantity of concrete used to construct the relieving slab. It is estimated that the cost of the unreinforced corrugated metal arch structure together with the concrete relieving slabs is at least 20% more than that of the composite structure of the present invention.

The present invention overcomes the problems associated with live loads over arch structures with shallow covers by increasing the bending moment capacity of the arch structure itself at the crown and hip portions. The provision of a continuous curved stiffener over the structure allows the structure to resist positive and negative bending moments. Moreover, during the installation stage of the structure, peaking could occur in the crown portion due to earth pressures acting on the sides. In this situation, negative bending will occur in the crown portion of the structure which the composite concrete/metal arch structure of the present invention is equally capable of resisting. This presents a significant advantage over any of the prior art which are mainly designed for limited positive moment resistance and which is not capable of resisting negative moments simultaneously without additional elaborated reinforcing means. Furthermore, by increasing the bending moment capacity in a curved beam column subjected to combined bending and axial loads, the combined bending and axial load capacity of the column is also increased.

Although preferred embodiments of the invention are described herein in detail, it will be understood by those skilled in the art that variations may be made thereto without departing from the spirit of the invention or the scope of the appended claims.

I claim:

1. A composite concrete reinforced corrugated metal arch structure comprising:

i) a first set of shaped corrugated metal plates interconnected in a manner to define a base arch structure of a defined span cross-section, height and longitudinal length, said base arch having a crown section and adjoining hip section for said span cross-section corrugated metal plates of defined thickness having corrugations extending transversely of the longitudinal length of said arch to provide a plurality of curved beam columns in said base arch;

ii) a second series of corrugated metal plates with at least one corrugation are interconnected in a manner to overlay and contact the first set of interconnected plates of said base arch with trough portions of the second corrugated plate secured to crest portions of the first set of plates, said second series of interconnected plates extending continuously in the transverse direction from a base portion of one of said hip sections over said crown section to a base portion of the other of said hip sections;

iii) said interconnected series of second plates ad said first set of plates defining a plurality of individual, transversely extending, enclosed continuous cavities, each said cavity being defined by an interior surface of said first set of plates and an opposing interior surface of said second series of plates;

iv) concrete filling each said continuous cavity from cavity end to end as defined by the transverse extent of said second series of plates, said concrete filled cavity defining an interface of said concrete encased by said metal interior surfaces of said interconnected second series of plates and first set of plates;

v) said interior surfaces of said cavity for each of said first and second plates having a plurality of shear bond connectors at said encased concrete-metal composite interface, said composite shear bond connectors being a rigid part of said first and second plates to ensure that the concrete and metal act in unison when a load is applied to said arch structure, said shear bond connectors providing a plurality of curved beam column stiffeners to enhance combined positive and negative bending resistance and axial load resistance of said base arch structure, there being a sufficient number of said second series of plates to provide a sufficient number of said curved beam column stiffeners to support anticipated loads imposed on said structure.

2. An arch structure of claim 1, wherein said second series of plates are flat.

3. An arch structure of claim 1, wherein said second series of plates have a number of corrugations per unit width of plate, greater than a number of corrugations per same unit width of said first plate.

4. An arch structure of claim 1, wherein said corrugations of said second series of plates are sinusoidal or polygonal in cross-sectional shape.

5. An arch structure of claim 1 wherein said structure is an ovoid culvert, a re-entrant arch, a box culvert, round culvert or elliptical culvert.

6. An arch structure of claim 1 wherein said shear bond connectors at said composite interface comprise a plurality of integral laterally projecting lugs formed in said first and second plates for resisting relative movement between said concrete and said first and second set of metal plates.

7. An arch structure of claim 1 wherein said shear bond connectors at said composite interface comprise inwardly projecting studs secured to said interior surfaces of said cavity defined by said first set of plates and said series of second plates.

8. An arch structure of claim 1 wherein said shear bond connectors at said composite interface comprise embossing formed on the interior surfaces of said first and second plates.

9. An arch structure of claim 1 wherein each second series of plates have a single corrugation.

10. An arch structure of claim 1 wherein each second series of plates having multiple corrugations to define a plurality of adjacent transversely extending cavities, at least one of said adjacent cavities having said shear bond connectors and filled with concrete to provide said curved beam column stiffener.

11. An arch structure of claim 10, wherein each of said adjacent cavities have said shear bond connectors and are filled with concrete to provide adjacent groups of said curved beam column stiffeners.

12. An arch structure of claim 1 wherein a second set of corrugated plates overlay said first set of plates, said second set of plates overlay continuously in the longitudinal length direction said first set of plates for a length which is effectively supporting load, selected cavities having said shear bond connectors and filled with concrete to provide said sufficient number of said curved beams column stiffeners.

13. An arch structure of claim 12 wherein adjacent cavities each have said shear bond connectors and filled with concrete to provide adjacent curved beam column stiffeners along said effective longitudinal length of said structure which supports the load.

14. An arch structure of claim 11 wherein said corrugated plate of each said first and second set of plates has the same sinusoidal profile whereby each said cavity is defined by adjacent crests of said first set being bolted to aligned adjacent troughs of said second set.

15. An arch structure of claim 14 wherein said shear bond connectors comprise inwardly projecting studs secured to said interior surfaces of each cavity, said studs being staggered along opposing interior surfaces of said first and second set of plates.

16. An arch structure of claim 15 wherein said corrugated plate has a sinusoidal corrugation profile of a selected depth of 25 mm to 150 mm and a selected pitch of 125 mm to 450 mm.

17. An arch structure of claim 16 wherein said span exceeds 15 m.

18. An arch structure of claim 17 wherein plugs are provided at each cavity end.

19. An arch structure of claim 18 wherein said cavity is filled with concrete through a plurality of holes in said second series of plates, each hole being plugged after concrete fill of each said individual cavity is complete.

* * * * *